United States Patent [19]

Ohki et al.

[11] 4,207,852

[45] Jun. 17, 1980

[54] NON-CONTACT IGNITION SYSTEM FOR AN INTERNAL COMBUSTION ENGINE

[75] Inventors: Yoshinori Ohki; Hirokichi Komiya, both of Tokyo, Japan

[73] Assignee: Iida Denki Kogyo Co., Ltd., Tokyo, Japan

[21] Appl. No.: 10,321

[22] Filed: Feb. 7, 1979

[30] Foreign Application Priority Data

| | | | |
|---|---|---|---|
| Feb. 10, 1978 | [JP] | Japan | 53-14755 |
| Feb. 13, 1978 | [JP] | Japan | 53-15223 |
| Feb. 23, 1978 | [JP] | Japan | 53-20232 |
| Feb. 23, 1978 | [JP] | Japan | 53-22681 |

[51] Int. Cl.[2] ..... F02P 1/00

[52] U.S. Cl. ..... 123/148 E; 322/17; 315/218; 310/70 A

[58] Field of Search ..... 123/148 E, 149 D; 315/218; 322/17; 310/70 A

[56] References Cited

U.S. PATENT DOCUMENTS

| | | | |
|---|---|---|---|
| 3,938,491 | 2/1976 | Mazza | 123/148 E |
| 3,963,015 | 6/1976 | Haubner | 123/148 E |
| 4,090,488 | 5/1978 | Ohki | 123/148 E |

*Primary Examiner*—Ronald B. Cox

*Attorney, Agent, or Firm*—Fidelman, Wolffe & Waldron

[57] ABSTRACT

The present invention discloses a system which utilizes the storage action of capacitors and the characteristic of the turn-off operation due to a potential difference between the base and emitter of a transistor, and immediately after a primary short-circuit current flowing through a primary winding of an ignition coil has reached a maximum, that is, immediately after a forward induced voltage in the primary winding has reached a maximum, the primary short-circuit current is cut off in accordance with information in which the forward induced voltage in the primary winding is at its maximum to always effect the ignition operation immediately after the primary short-circuit current is at its maximum.

11 Claims, 17 Drawing Figures

NON-CONTACT IGNITION SYSTEM FOR AN INTERNAL COMBUSTION ENGINE

The present invention relates to a non-contact ignition system for an internal combustion engine in which the fuel is burned to reciprocate a piston within a cylinder thereby obtaining the turning force, and more specifically, to a so-called induction discharge type ignition system in which a primary short-circuit current in accordance with an induced voltage generated in a primary winding of an ignition coil in the construction of a high voltage magneto-generator is rapidly cut off to thereby produce a spark discharge in a plug connected to a secondary winding of the ignition coil.

With the development of semi-conductor elements, the ignition system for an internal combustion engine is being converted in its type from a conventional contact point system contact type to a non-contact type making use of semi-conductor elements such as transistors, thyristors and the like.

As compared with the contact type ignition system, the non-contact type ignition system has various advantages that the system has a long service life and is high in reliability, that the system is small in type and is light-weighted, that the system is inexpensive and easy in manufacture, and that the system can be mounted any place relatively freely as well as easy handling and various settings.

The method of ignition operation of the non-contact type ignition system, which has various advantages as noted above over the contact type ignition system, includes, in case of the induction discharge type, a method in which the ignition operation is accomplished at the time when the forward induced voltage in the primary winding of the ignition coil has reached a predetermined value, and a method in which similarly to the case of the contact type, the range of an electric angle wherein the value of the forward induced voltage in the primary winding is turned into the value capable of generating a spark discharge in the plug connected to the primary winding is mechanically known and the ignition operation is accomplished by means of a trigger coil or a cam at a suitable time within the range of electric angle.

In any of these methods of ignition operation, the ignition operation itself may be accomplished smoothly without any difficulty. However, settings of various values for the setting of a trigger level until the desired ignition operation is effected and the setting of mechanical positions are required, and it has not always been easy to mount the system on the body of the internal combustion engine.

Also, the most significant problem involved in the ignition system of the type as described is as to how to decrease the number of revolutions at the start.

That is, since rotational speed of the internal combustion engine at the time of starting is extremely low, it is not possible to obtain a sufficiently high forward induced voltage in the primary winding of the ignition coil and hence, it is difficult to obtain a sufficient ignition energy.

For this reason, a large ignition coil is used in order that the sufficient ignition energy may be obtained when the engine runs at a low speed including the starting time, whereby the sufficiently high forward voltage may be obtained in the primary winding even at the low speed including the starting time to effect the ignition operation without hindrance.

However, the ignition coil that may produce the sufficient ignition energy even at the low speed is used as described above, and as a consequence, when rotational speed of the internal combustion engine increases up to a normal level, the ignition energy produced in the ignition coil becomes excessively large, resulting in various inconveniences such as broken plug and increase in rating of various semi-conductor elements which constitute the ignition circuit.

It has been sometimes necessary to provide a circuit used to cut an unnecessarily high induced voltage produced in the ignition coil.

Further, since it is necessary for the above-mentioned non-contact ignition system to provide a circuit for compensating for a temperature characteristic of semi-conductor elements used, when the ignition circuit is in a off state, impedance in the circuit is low. For this reason, the switching ratio as the circuit becomes worsened, causing the performance to be deteriorated.

As described above, in the conventional non-contact ignition systems, a large ignition coil must be used in an effort to obtain a sufficient ignition energy at the time of low speed, and hence, iron loss or copper loss at the time of normal speed increases and the forward induced voltage generated at the normal speed tends to be excessively high. As a result, the rating of the semi-conductor elements being used must be increased. Further, since all the generated electric energy is not utilized as the ignition energy, it is hard to say that good electric efficiency is obtained. In addition, the provision of various compensation circuits such as a temperature compensation circuit is necessary, and as a result, the circuit construction is complicated. Above all, ignition timing must be adjusted every internal combustion engine mounted, resulting in inconveniences in terms of manufacture, cost, efficiency and use.

The present invention has been achieved in an attempt to overcome the disadvantages and inconveniences as noted above with respect to prior art systems by providing an arrangement wherein the maximum value of a forward voltage induced in a primary winding of an ignition coil, and when the forward induced voltage in the primary winding is at its maximum, the ignition operation may be accomplished, thereby materially improving the starting characteristic, simplifying the circuit construction and rendering the handling simple.

Accordingly, it is an object of the present invention to always accomplish the ignition operation immediately after the forward induced voltage in the primary winding of the ignition coil is at its maximum value to thereby obtain a sufficient ignition energy at the time of low speed even in a small ignition coil.

Another object of the present invention is to accomplish the ignition operation in accordance with the value of the induced voltage in the primary winding, as described above, to thereby totally eliminate the necessity of adjustment of ignition timing required every internal combustion engine mounted.

Another object of the present invention is to provide an arrangement wherein the forward maximum electric energy produced in the primary winding may be always utilized to accomplish the ignition operation so that the ignition coil may be made smaller in type and the rating of semi-conductor elements being used may be decreased, whereby the ignition system may be manufactured at a low cost.

Still another object of the present invention is to provide an arrangement wherein the triggering of the semiconductor elements may be controlled in terms of potential difference to effect the ignition operation so that it is not necessary to compensate for the temperature characteristic of each of semi-conductor elements, thus eliminating the necessity of provision of various auxiliary circuits to simplify the circuit structure.

The above and other objects and features of the invention will appear more fully hereinafter from a consideration of the following description taken in connection with the accompanying drawings wherein preferred embodiments are illustrated and claims.

Figure 1:
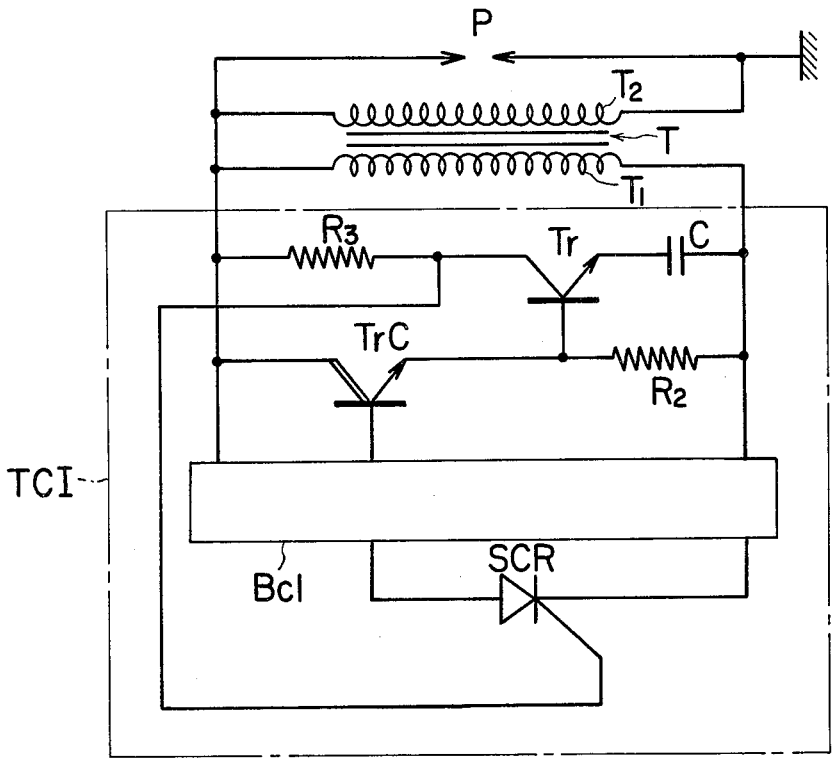
FIG. 1 is a circuit diagram showing the most basic circuit construction in accordance with the present invention.
Figure 3:
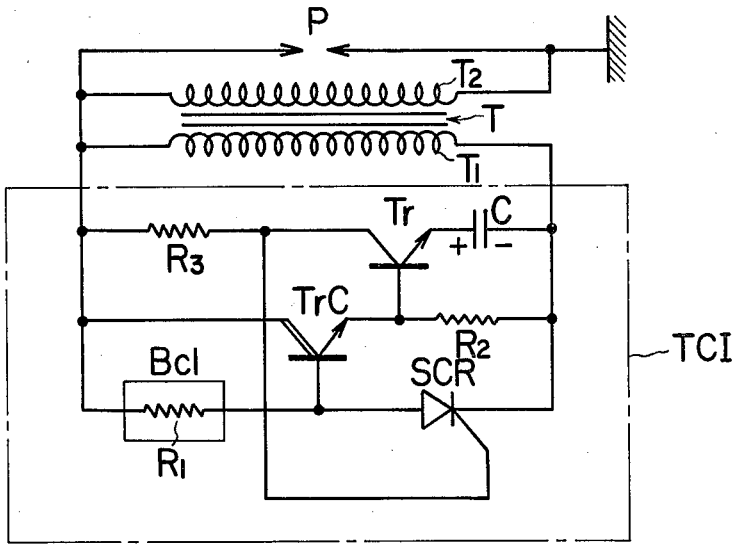
Figure 4:
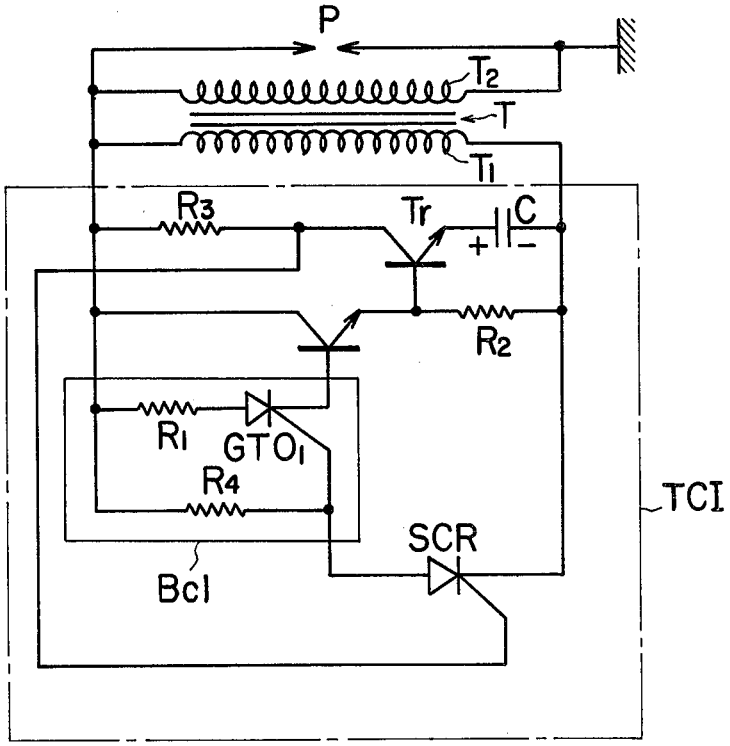
Figure 5:
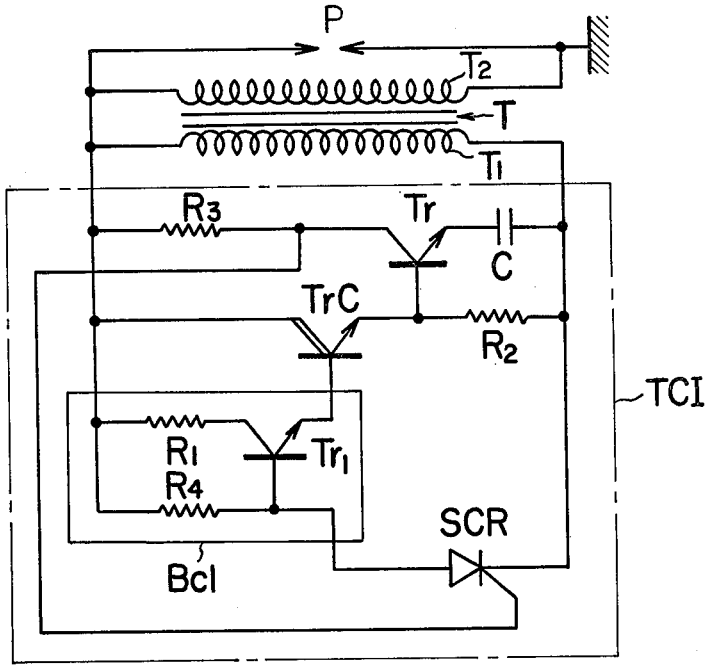
Figure 6:
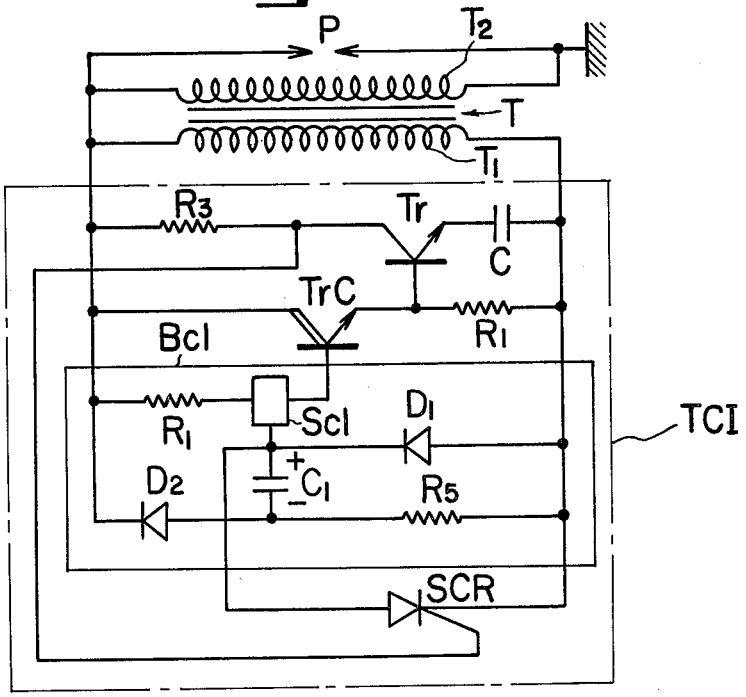
Figure 7:
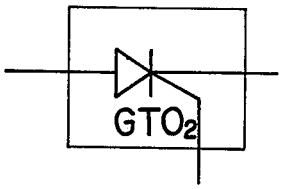
Figure 8:
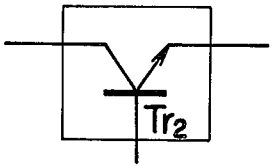
Figure 9:
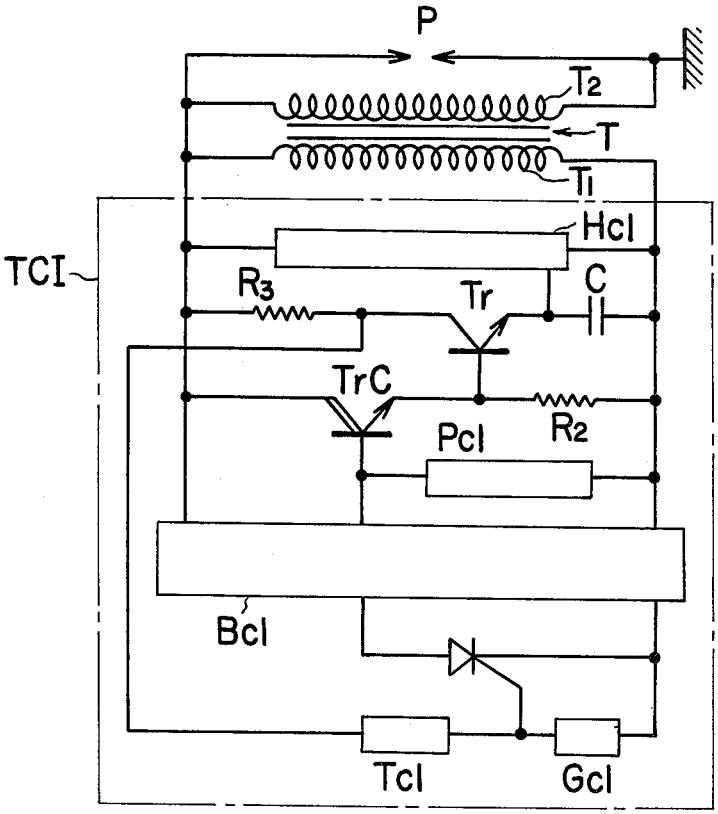
Figure 10:
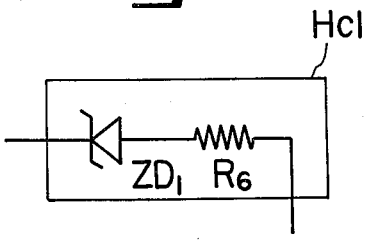
Figure 11:
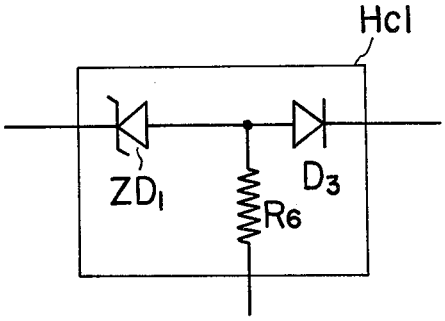
Figure 12:
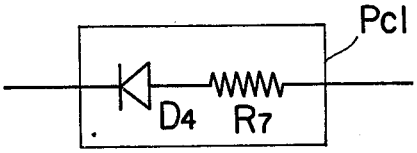
Figure 13:
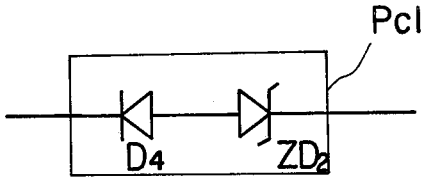
Figure 14:
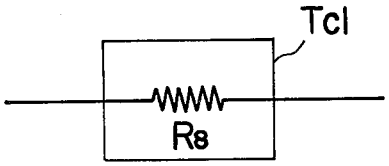
Figure 15:
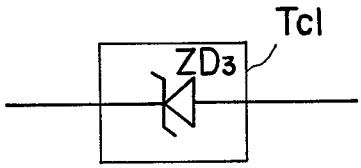
Figure 16:
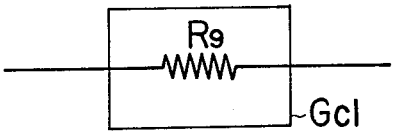

FIGS. 3 to 8 are diagrams illustrating the embodiments of the base circuit of FIG. 1, in which FIG. 3 shows an embodiment constructed only by resistors, FIG. 4 shows an embodiment using a gate turn switch, FIG. 5 shows an embodiment using transistors, FIG. 6 shows an embodiment designed to secure the most positive operation of the base circuit, FIG. 7 shows an embodiment using a gate turn off thyristor as a switching circuit in FIG. 6, and FIG. 8 shows an embodiment using a transistor as a switching circuit in FIG. 6;

FIG. 9 is a circuit diagram in which various auxiliary circuits are incorporated in the circuit of the present invention shown in FIG. 1;

FIGS. 10 and 11 show embodiments of discharge circuits out of the auxiliary circuits;

FIGS. 12 and 13 show embodiments of premature ignition prevention circuits out of the auxiliary circuits;

FIGS. 14 and 15 show embodiments of trigger circuits out of the auxiliary circuits;

FIG. 16 shows one example of a gate circuit out of the auxiliary circuits; and

Figure 17:
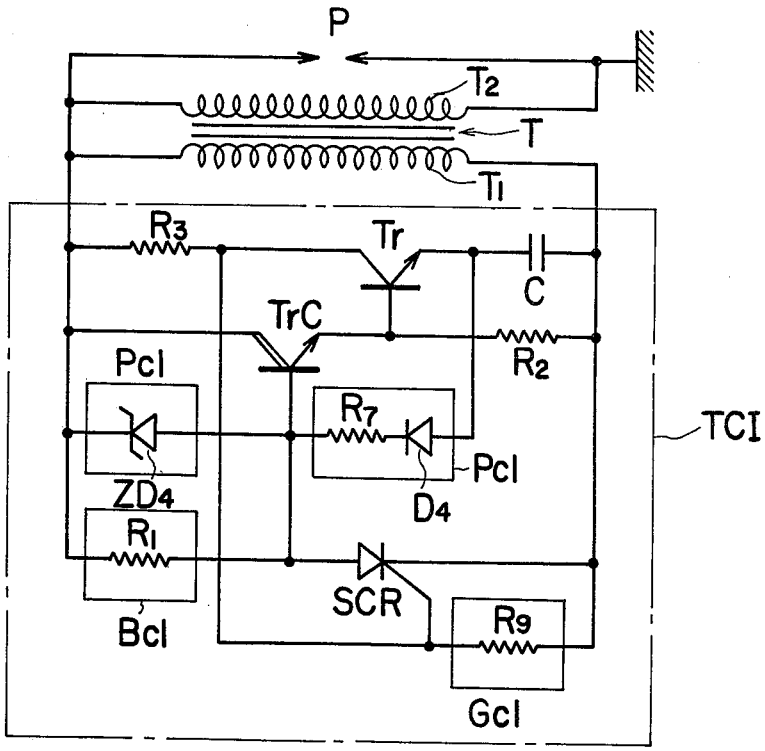

FIG. 17 shows an embodiment in which the premature ignition prevention circuit also serves as a discharge circuit out of the auxiliary circuits.

The present invention relates to a so-called induction discharging type non-contact ignition system for an internal combustion engine in which an ignition circuit TCI is connected to a primary winding $T_1$ of an ignition coil T having its secondary winding $T_2$ connected to a plug P. The system has a basic construction wherein as shown in FIG. 1, in parallel with the primary winding $T_1$ is connected a series circuit comprising a resistor $R_3$ having a high resistance, a transistor Tr and a capacitor C and a series circuit comprising a transistor circuit TrC (While a Darlington circuit is employed in the illustrated embodiment, a single power transistor will also suffice.) and a resistor $R_2$ having a very small resistance, and a base circuit Bc1 which triggers said transistor circuit TrC by the self-triggering system, said transistor circuit TrC having its base to which a thyristor SCR for controlling the turn-off of the transistor circuit TrC is connected, said transistor Tr having its base connected to the emitter of the transistor circuit TrC and the transistor Tr having its collector connected to the gate of the thyristor SCR, to form an ignition circuit TCI.

It will be noted in the following description that all transistors used here are of NPN-type transistors.

While various constructions may be considered as to the base circuit Bc1 shown by the block in the basic circuit diagram of FIG. 1, FIG. 3 shows the simplest example of the base circuit Bc1 only comprised of a resistor $R_1$ having a high resistance value.

In the case of the embodiment shown in FIG. 3, the resistor $R_1$ is inserted between the collector and base of a transistor circuit TrC so as to serve as the base resistor of the transistor circuit TrC.

A thyristor SCR is in a state where it is inserted between the base of the transistor circuit TrC and the primary winding $T_1$.

The embodiments of the base circuit Bc1 shown in FIGS. 4 and 5 are designed so that the transistor circuit TrC may be positively turned off by turning off the thyristor SCR. In the case of the embodiment shown in FIG. 4, a series circuit comprising a resistor $R_1$ and a gate turn-off switch $GTO_1$ is inserted between the collector and base of the transistor circuit TrC, and a resistor $R_4$ for triggering the gate turn-off switch $GTO_1$ is inserted between the gate of the gate turn-off switch $GTO_1$ and collector of the transistor circuit TrC.

In the case of the embodiment shown in FIG. 5, a transistor $Tr_1$ is merely used in place of the gate turn-off switch $GTO_1$ in the embodiment shown in FIG. 4.

In the cases of the embodiments shown in FIGS. 4 and 5, the thyristor SCR for controlling the turn-off of the transistor circuit TrC has its anode connected to the gate of the gate turn-off switch $GTO_1$ in the embodiment shown in FIG. 4 and connected to the base of the transistor $Tr_1$ in the embodiment shown in FIG. 5.

The embodiment shown in FIG. 6 is designed so that simultaneously with the building up of the forward voltage in the primary winding $T_1$, the transistor circuit TrC is triggered and the transistor circuit is positively turned off in accordance with the triggering of the thyristor SCR. In this embodiment, a series circuit comprising a resistor $R_1$ and a switching circuit Sc1 using a gate turn-off switch $GTO_2$ shown in FIG. 7 or a switching circuit Sc1 using a transistor $Tr_2$ shown in FIG. 8 is inserted between the collector and base of the transistor circuit TrC, a series circuit comprising a capacitor $C_1$ and an inversed diode $D_1$ is inserted in parallel with the primary winding $T_1$ so that said series circuit is connected in parallel with a resistor $R_5$, and said parallel circuit is connected in series with an inversed diode $D_2$, the gate or base of the switching circuit Sc1 being connected to a positive electrode of the capacitor $C_1$ to which the cathode of the diode $D_1$ is connected.

In the case of the embodiment shown in FIG. 6, the thyristor SCR has its anode connected to the gate or base of the switching circuit Sc1.

Next, the basic ignition operation of the present invention will be explained by way of the simplest embodiment shown in FIG. 3.

Figure 2:
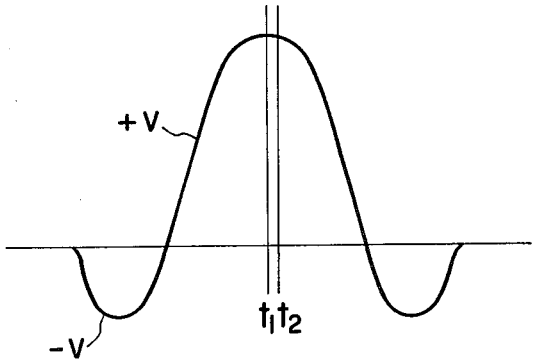
FIG. 2 is a diagram showing timing of ignition timing with respect to an induced voltage in a primary winding indicative of fundamentals of the ignition operation in accordance with the present invention.

As is known, the inverse voltage $-v$ builds up as shown in FIG. 2 in the primary winding $T_1$ before the forward voltage $+v$ builds up therein.

The inverse voltage $-v$ generated immediately before the forward voltage $+v$ builds up is partly charged, by making use of the reverse leakage characteristic of the transistor Tr, into the capacitor C in the route of the primary winding $T_1 \rightarrow$ capacitor C $\rightarrow$ emitter of transistor Tr $\rightarrow$ collector of transistor Tr $\rightarrow$ primary winding $T_1$.

As described above, since the inverse voltage is charged into the capacitor C when the inverse voltage −v is produced, when the inverse voltage −v decreases and the forward voltage +v begins to build up, the inverse voltage charged in the capacitor C is discharged in the route of the capacitor C → resistor $R_2$ → base of transistor Tr → emitter of transistor Tr → capacitor C so that the transistor Tr assumes a triggering state.

Then, when the forward voltage +v begins to build up in the primary winding $T_1$, base current flows into the base of the transistor circuit TrC through the resistor $R_1$ in the base circuit Bc1 so that the transistor circuit TrC is turned on to provide primary short-circuit current into the primary winding $T_1$.

When the transistor circuit TrC is turned on, the transistor Tr is also turned on, and the forward electric charge begins to be charged into the capacitor C.

A potential of the positive side electrode of the capacitor C for charging the forward charge is substantially the same potential as that of the emitter of the transistor circuit TrC because the transistor Tr is in a turned-on state, and follows the potential of the emitter of the transistor circuit TrC which rises as a result of the voltage drop in the resistor $R_2$ as the primary short-circuit current increases.

When the value of the forward voltage +v is at its maximum or at time $t_1$ (see FIG. 2), the potential of the emitter of the transistor circuit TrC reaches its maxium or time $t_1$, after which the potential of the emitter of the transistor circuit TrC lowers.

On the contrary, a potential of the negative side electrode of the capacitor C does not lower as the primary short-circuit current flowing into the primary winding $T_1$ through the transistor circuit TrC and resistor $R_2$ decreases but rises as the primary short-circuit current increases and remains at its maximal value at time $t_1$, and hence, at suitable time $t_2$ after passing the time $t_1$, the potential of the positive side electrode of the capacitor C will be higher than the potential of the emitter of the transistor circuit TrC.

That is, it will be apparent that the potential of the emitter of the transistor Tr connected to the positive side electrode of the capacitor C becomes higher than the potential of the base of the transistor Tr connected to the emitter of the transistor circuit TrC.

For this reason, at time $t_1$ the transistor Tr is turned off to thereby generate a high surge voltage in the collector of the transistor Tr.

This surge voltage is applied to the gate of the thyristor SCR connected to the collector of the transistor Tr, which voltage is formed into a trigger pulse to turn on the thyristor SCR.

When the thyristor SCR is turned on, the base of the transistor circuit TrC is short-circuited to the negative side terminal of the primary winding $T_1$, and as a result, it is turned off to rapidly cut off the primary short-circuit current.

The rapid cutting off of the primary short-circuit current resulting from the turn-off of the transistor circuit TrC induces a high voltage in the secondary winding $T_2$ to produce a spark discharge in plug P so that the ignition operation is accomplished.

In accordance with the present invention, thus, the forward induced voltage +v in the primary winding $T_1$ is monitored by the capacitor C and the transistor Tr, and the ignition operation is carried out immediately after the forward voltage +v in the primary winding $T_1$ is at its maximum value.

It goes without saying that the forward electric charge charged in the capacitor C is discharged by making use of the reverse leakage characteristic of the transistor Tr.

As is apparent from the basic ignition operation of the present invention making use of the embodiment shown in FIG. 3, the present invention provides an arrangement wherein the forward voltage +v produced in the primary winding $T_1$ is partly charged into the capacitor C, variations of the forward voltage +v in the primary winding $T_1$ are monitored by the transistor Tr making use of a charged potential of the capacitor C, and the ignition operation is effected when the forward voltage +v in the primary winding $T_1$ exceeds. As is apparent from the aforesaid basic operation, however, the resistor $R_2$ merely provides a potential difference between the emitter of the transistor circuit TrC and the terminal at the negative side of the primary winding $T_1$ at the time the forward voltage +v is produced in the primary winding $T_1$, and therefor, it is desirable that the resistance value thereof is made as small as possible even for the purpose of making a power loss as the circuit as small as possible.

On the other hand, the resistor $R_3$ is merely provided to pass an electric current to the extent that the transistor Tr is held in its turn-on state and is set in value as large as possible since it is necessary to make the primary short-circuit current passing through the transistor circuit TrC as large as possible.

For example, in the case the capacitor C of approximately 10 μF is used, the resistor $R_2$ is about 0.5 Ω, and the resistor $R_3$ is about 10 KΩ.

In the case of the embodiment shown in FIG. 3, the resistor $R_1$ of about 1 KΩ is used.

FIGS. 4 and 5 show embodiments in which the base circuit Bc1 is designed so that the transistor circuit TrC is positively turned off as the thyristor SCR is turned on. In the turn-on operation of the transistor circuit TrC, at the same time when the forward voltage +v builds up, current flows into the gate of the gate turn-off switch $GTO_1$ or the base of the transistor $Tr_1$ through the resistor $R_4$ to turn on the gate turn-off switch $GTO_1$ or transistor $Tr_1$, and when the gate turn-off switch $GTO_1$ or transistor $Tr_1$ is turned off, current flows into the base of the transistor circuit RcC from the resistor $R_1$ through the gate turn-off switch $GTO_1$ or transistor $Tr_1$ to turn on the transistor circuit TrC.

On the other hand, in the turn-off operation of the transistor circuit TrC, when the thyristor SCR is turned on, the gate of the gate turn-off switch $GTO_1$ or the base of the transistor $Tr_1$ is negatively biased whereby the gate turn-off switch $GTO_1$ or transistor $Tr_1$ is positively turned off to thereby cut off the base current to the transistor TrC so that the transistor circuit TrC is turned off.

Thus, the base circuit Bc1 of the transistor circuit TrC is not comprised of only resistor $R_1$ but comprised as shown in FIGS. 4 and 5 so that when the thyristor SCR is turned on, the transistor circuit TrC is positively turned off. The reason is that the thyristor SCR, even in its turn-on state, produces a slight voltage drop with the result that there possibly occurs a state where the transistor circuit TrC is not turned off by the voltage drop in the turned-on thyristor SCR (the base potential of the transistor circuit TrC is made higher by a portion of the voltage drop in the thyristor SCR), and hence, the occurrence of such inconveniences must positively be prevented.

FIGS. 6 to 8 show other embodiments of the base circuit Bc1. In this embodiment, the inverse voltage $-v$ produced before the forward voltage $+v$ in the primary winding $T_1$ is partially charged into the capacitor $C_1$ in the route of the primary winding $T_1 \rightarrow$ diode $D_1 \rightarrow$ capacitor $C_1 \rightarrow$ diode $D_2 \rightarrow$ primary winding $T_1$.

The value of the voltage charged into the capacitor $C_1$ is set by the resistor $R_5$ connected in parallel with the capacitor $C_1$.

Since the positive side electrode of the capacitor $C_1$ charged with a part of the inverse voltage $-v$ is connected to the gate of the gate turn-off switch $GTO_2$ constituting the switching circuit Sc1 or the base of the transistor $Tr_2$, when the inverse voltage $-v$ decreases and the forward voltage $+v$ commences to build up, electric charge charged in the capacitor $C_1$ is discharged into the gate of the gate turn-off switch $GRO_2$ or the base of the transistor $Tr_2$ to trigger the gate turn-off switch $GTO_2$ or transistor $Tr_2$.

Since the forward voltage $+v$ then commences to build up, the switching circuit Sc1 is turned on simultaneously with the generation of the forward voltage $+v$ so that the transistor circuit TrC may be turned on almost simultaneously with the generation of the forward voltage $\pm v$.

Further, when the thyristor SCR is turned on, a control terminal (the gate in case of the gate turn-off switch $GTO_2$, and the base in case of the transistor $Tr_2$) of the switching circuit Sc1 is negatively biased by the turn-on of the thyristor SCR with the result that the switching circuit Sc1 is turned off. Base current of the transistor TrC is cut off by the turn-off of the switching circuit Sc1 to rapidly and positively turn off the transistor circuit TrC.

The turn-off operation of the transistor circuit TrC is exactly the same as that of the embodiments shown in FIGS. 4 and 5 as previously described.

As described above, in accordance with the present invention, the forward voltage $+v$ in the primary winding $T_1$ is monitored and the ignition operation is carried out at time $t_2$ after a slight lapse of time $t_1$ at which the forward voltage $+v$ is at its maximum, and it is therefore possible to obtain a large ignition energy at all times. In the following, however, main auxiliary circuit employed to provide a better achievement of various operations of the present invention will be described.

As shown in FIG. 9, the auxiliary circuit includes a discharge circuit Hc1 which forms a charge and discharge circuit to a capacitor C and which functions to absorb a surge voltage produced when a primary short-circuit current is cut off, a premature firing (prespark) prevention circuit Pc1, a trigger circuit Tc1 for stabilizing the trigger operation of thyristor SCR, and a gate circuit Gc1 of thyristor SCR provided as necessary.

The discharge circuit Hc1 may be constructed as shown in FIGS. 10 and 11.

In the circuit shown in FIG. 10, a series circuit comprising an inversed Zener diode $ZD_1$ and a resistor $R_6$ is connected to a series circuit comprising a resistor $R_3$ and a transistor Tr.

That is, in operation, the inverse voltage $-v$ induced before generation of the forward voltage $+v$ is partly charged into the capacitor C in the route of the primary winding $T_1 \rightarrow$ capacitor C $\rightarrow$ resistor $R_6 \rightarrow$ Zener diode $ZD_1 \rightarrow$ primary winding $T_1$ without making use of the reverse leakage characteristic of the transistor Tr, and after completion of the ignition operation, the forward voltage $+v$ charged in the capacitor C is partly discharged from the resistor $R_6$ through the Zener diode $ZD_1$.

Further, when the transistor circuit TrC is turned off to rapidly cut off the primary short-circuit current, an extremely high surge voltage is generated between both terminals of the primary winding $T_1$. However, if the surge voltage directly acts on the transistor circuit TrC, transistor Tr and thyristor SCR, parts constituting these main circuits may possibly be deteriorated though not breaking them down, and hence, the surge voltage is broken down by the Zener diode $ZD_1$ and absorbed by the capacitor C.

In the discharge circuit Hc1 shown in FIG. 11, a forward diode $D_3$ is additionally connected in parallel with the capacitor C in addition to the circuit shown in FIG. 10. While, in this embodiment, the charge and discharge operations of the capacitor C is accomplished exactly in the same manner as that of the embodiment shown in FIG. 10, the absorption of the surge voltage generated when the transistor circuit TrC is turned off is achieved by being short-circuited to the primary winding $T_1$ from the broken down Zener diode $ZD_1$ via the diode $D_3$ without using the capacitor C.

For this reason, in case of the embodiment shown in FIG. 11, the circuit construction as the discharge circuit Hc1 becomes complicated by a portion of the diode $D_3$ as compared with the embodiment shown in FIG. 10. On the contrary, however, in the embodiment shown in FIG. 11, the surge voltage need not be absorbed by the capacitor C, and therefore there is an advantage that the value of the capacitor C, which forms a part constituting the main circuit, may be freely set.

FIGS. 12 and 13 show an embodiment of the premature firing prevention circuit Pc1, which is provided to pass an inverse current in accordance with an inverse voltage generated in the primary winding in a limited state, thereby suppressing the building up of the inverse voltage in the primary winding $T_1$ to prevent an occurrence of the ignition operation at an improper time.

In case of the embodiment shown in FIG. 12, the premature firing prevention circuit Pc1 is constructed such that the reversed diode $D_4$ is connected in series with a current limiting resistor $R_7$, the circuit Pc1 being inserted between the base of the transistor circuit TrC and the negative side terminal of the primary winding $T_1$ when the forward voltage is produced.

In the premature firing prevention circuit Pc1, when the inverse voltage is produced in the primary winding $T_1$, an inverse current in accordance with the inverse voltage is passed from the resistor $R_7$ to the transistor circuit TrC through the diode $D_4$, and the inverse current is passed into the primary winding $T_1$ through the transistor circuit TrC in accordance with the reverse leakage characteristic of the transistor circuit TrC.

Where the transistor circuit TrC comprises a Darlington circuit, the operation of flowing the inverse current by means of the premature firing prevention circuit Pc1 shown in FIG. 12 may be accomplished in an extremely good manner, whereas where the transistor circuit TrC comprises a single power transistor, an absolute quantity of the inverse current passing through the collector from the base of the transistor circuit TrC is considerably regulated, and thus it is not possible to achieve a good premature firing prevention effect.

Accordingly, where the transistor circuit TrC comprises a single power transistor, it will be advantageous to insert a reversed Zener diode $ZD_4$ as a part of the premature firing prevention circuit Pc1 between the collector and base of the transistor circuit TrC, as shown in FIG. 17, so that the inverse current may flow into the primary winding $T_1$ without passing through the transistor circuit TrC.

Another embodiment of the premature firing prevention circuit Pc1 shown in FIG. 13 uses a forward Zener diode $ZD_2$ in place of the resistor $R_7$ in the embodiment shown in FIG. 12. In this embodiment, when the inverse voltage in the primary winding $T_1$ exceeds a certain level, the premature firing prevention circuit Pc1 is activated.

FIGS. 14 and 15 show a trigger circuit Tc1 inserted in the gate of the thyristor SCR, the trigger circuit Tc1 being provided to prevent an improper trigger operation.

That is, an ignition coil T comprises a high voltage magneto generator so that the voltage induced in the primary winding $T_1$ contains a higher harmonic component.

It is therefore fully appreciated that a harmonic voltage having a pulsewise high voltage is sometimes generated in the forward voltage +v in the primary winding $T_1$.

When the harmonic pulse of high voltage value is generated before normal ignition takes place, the harmonic pulse is applied to the gate of the thyristor SCR through the resistor $R_3$ to improperly trigger the thyristor SCR.

In order to prevent the inconveniences noted above, the trigger circuit Tc1 is provided, and a pure resistor $R_8$ is used in case of the embodiment shown in FIG. 14 while a Zener diode $ZD_3$ in the form of the reverse attitude is used in case of the embodiment shown in FIG. 15.

FIG. 16 shows an embodiment of a gate circuit Gc1 for stabilizing the trigger operation of the thyristor SCR. In the present invention, it is not totally necessary to temperature-compensate for the operating characteristic of the thyristor SCR. Thus, as shown, only the pure resistor $R_9$ will suffice to enable sufficiently stabilizing the trigger operation of the thyristor SCR.

While various main auxiliary circuits may be taken into consideration in the present invention, as previously mentioned, incorporation of the above-mentioned auxiliary circuits depends upon the kind of internal combustion engine on which the ignition device of the present invention is mounted, running conditions of the internal combustion engine, generation capacity (ampere-turn), cost and the like.

It should also be noted that the above-mentioned auxiliary circuits are not always individually and independently provided but may be connected for use, for example, as in the embodiment shown in FIG. 17, so that the premature firing prevention circuit Pc1 also functions as the discharge circuit Hc1.

That is, in case of the embodiment shown in FIG. 17, the premature firing prevention circuit Pc1 connected to the negative side terminal at the time of generation of a forward voltage in the primary winding $T_1$ has its terminal connected to the emitter of the transistor Tr connected to the capacitor C, and a reversed Zener diode $ZD_4$ as a part of the premature firing prevention circuit Pc1 is inserted between the collector and base of the transistor circuit TrC.

In case of the embodiment shown in FIG. 17, the operation of the premature firing prevention circuit Pc1 and the charging operation of the inverse voltage −v into the capacitor C will occur simultaneously.

When the inverse voltage −v builds up before the forward voltage +v, an inverse current flows in the route of the primary winding $T_1 \rightarrow$ capacitor C $\rightarrow$ diode $D_4 \rightarrow$ resistor $R_7 \rightarrow$ transistor circuit TrC and Zener diode $ZD_4 \rightarrow$ primary winding $T_1$ to prevent premature firing and charge inverse voltage into the capacitor C.

As previously mentioned, the inverse voltage −v charged in the capacitor C is partly discharged from the resistor $R_2$ through the base and emitter of the transistor Tr to place the transistor in a trigger state, thus effecting the ignition operation in order as described above.

At the time of ignition operation where the transistor circuit TrC is turned off, a surge voltage of high voltage is generated between both the terminals of the primary winding $T_1$. This surge voltage breaks down the Zener diode $ZD_4$ forming a part of the premature firing prevention circuit Pc1 and is absorbed by being short-circuited through the thyristor SCR in a conduction state.

Also, the forward voltage +v charged in the capacitor C is partly discharged from the diode $D_4$ through the resistor $R_7$ and Zener diode $ZD_4$.

In case of the embodiment shown in FIG. 17, as described above, the premature firing prevention circuit Pc1 is designed so that it may also function as the discharge circuit Hc1, whereby the number of auxiliary circuits required can be reduced.

In accordance with the system of the present invention, as described above, the forward voltage +v in the primary winding $T_1$ is partly charged into the capacitor C and the thus charged voltage of the capacitor C is monitored by the transistor Tr to thereby know the time at which the forward voltage +v in the primary winding $T_1$ assumes the maximum value, and the ignition operation is accomplished at time $t_2$ after a slight lapse of time $t_1$ at which the forward voltage +v is at its maximum, namely, at time $t_2$ at which the forward voltage +v commences to drop. Accordingly, the ignition operation may always be accomplished at the time when the electric energy is at maximum, thereby always obtaining a powerful ignition energy.

It is therefore possible to obtain sufficient ignition energy as compared with conventional ignition systems even in a state where sufficient electric energy is not available such as at the time of starting. For this reason, the starting characteristic rapidly progresses so that the starting may be achieved at rotational speed much lower than the conventional ignition systems.

This means that the generation capacity in the ignition coil T is not required in normal operation so much as it is required by prior art ignition systems, and as a consequence, the ignition coil T of the small type far smaller than ignition coils T used in conventional ignition systems may be used to achieve good ignition operation.

As described above, the generation capacity of the ignition coil T in normal operation may be decreased, and as a result, the rating of electric parts such as various semiconductor elements, which constitute the ignition circuit TCI, can be reduced to thereby lower the cost of electric parts constituting the circuits.

Above all, since the ignition timing is automatically set immediately after the forward voltage +v in the primary winding $T_1$ has reached its maximum value, it is not at all necessary to perform the setting operation of cumbersome ignition timing, and all that need be done is to mechanically install the system on the internal combustion engine, thus rendering the installation operation and handling very simple.

In addition, it is not at all necessary to provide with auxiliary circuits absolutely required in practical uses such as the temperature compensation circuit for main semiconductor elements constituting the circuit and the ignition timing control circuit, and hence, it is not only possible to simplify the circuit construction but also possible to improve the switching ratio, thus considerably increasing the electric efficiency as the circuit.

As is evident from the foregoing explanation, the present invention has various excellent operations and effects in that the device is simple in construction and easy for its manufacture, that the device may be manufactured in the form of small type and inexpensively, that the device may be handled very simply and always provide the stabilized ignition operation, and that the device may provide extremely good starting characteristic.

What is claimed is:

1. A non-contact ignition system for an internal combustion engine comprising an ignition coil T with a plug P connected to a secondary winding $T_2$, said ignition coil T having a primary winding $T_1$ connected in parallel with a series circuit comprising a resistor $R_3$ of a specified resistance value, a transistor Tr and a capacitor C and a series circuit comprising a transistor circuit TrC and a resistor $R_2$ of a lower than said specified valve resistance value, said transistor circuit TrC having a base connected to a base trigering circuit Bc1 for controlling the triggering of said transistor circuit TrC, said base circuit Bc1 having a thyristor SCR connected thereto to control the turn-off of said transistor circuit TrC, said transistor Tr having its base connected to the emitter of said transistor circuit TrC and its collector connected to the gate of said thyristor SCR.

2. An ignition system according to claim 1 wherein the base circuit Bc1 comprises a resistor $R_1$ of a high resistance value inserted between the collector and base of the transistor circuit TrC, said transistor circuit TrC having its base directly connected to the anode of the thyristor SCR.

3. An ignition system according to claim 1 wherein the base circuit Bc1 comprises a series circuit comprising a resistor $R_1$ of a high resistance value inserted between the collector and base of the transistor circuit TrC and a gate turn-off switch $GTO_1$ and a resistor $R_4$ inserted between the collector of said transistor circuit TrC and the gate of said gate turn-off switch $GTO_1$, said gate turn-off switch $GTO_1$ having its gate connected to the anode of the thyristor SCR.

4. An ignition system according to claim 3 wherein a transistor $Tr_1$ is used in place of the gate turn-off switch $GTO_1$ in the base circuit Bc1.

5. An ignition system according to claim 1 wherein the base circuit Bc1 comprises a series circuit comprising a resistor $R_1$ of a high resistance value inserted between the collector and base of the transistor circuit TrC and a gate turn-off switch $GTO_2$ and a capacitor $C_1$ for charging a part of an inverse voltage induced in the primary winding $T_1$, said capacitor $C_1$ having a positive side electrode connected to the gate of said gate turn-off switch $GTO_2$, the thyristor SCR having its anode connected to the gate of said gate turn-off switch $GTO_2$.

6. An ignition system according to claim 5 wherein a transistor $Tr_2$ is used in place of said gate turn-off switch $GTO_2$ in the base circuit Bc1.

7. A non-contact ignition system for an internal combustion engine comprising an ignition coil T with a plug P connected to a secondary winding $T_2$, said ignition coil T having a primary winding $T_1$ connected in parallel with a series circuit comprising a resistor $R_3$ of a specified resistance value, a transistor Tr and a capacitor C and a series circuit comprising a transistor circuit TrC and a resistor $R_2$ of a lower than said specified valve resistance value, said transistor circuit TrC having a base connected to a base trigering circuit Bc1 for controlling the triggering of said transistor circuit TrC, said base circuit Bc1 having a thyristor SCR connected thereto to control the turn-off of said transistor circuit TrC, said transistor Tr having its base connected to the emitter of said transistor circuit TrC and its collector connected to the gate of said thyristor SCR, said series circuit comprising a resistor $R_3$ and a transistor Tr being connected in parallel with a discharge circuit Hc1 comprised of a series circuit comprising a reversed Zener diode $ZD_1$ and a resistor $R_6$.

8. An ignition system according to claim 7 wherein the discharge circuit Hc1 comprises a series circuit comprising a reversed Zener diode $ZD_1$ and a resistor $R_6$ connected in parallel with a series circuit comprising a resistor $R_3$ and a transistor Tr, and a forward diode $D_3$ inserted between the anode of said Zener diode $ZD_1$ and a negative side terminal of the primary winding $T_1$ when the forward voltage is generated.

9. A non-contact ignition system for an internal combustion engine comprising an ignition coil T with a plug P connected to a secondary winding $T_2$, said ignition coil T having a primary winding $T_1$ connected in parallel with a series circuit comprising a resistor $R_3$ of a specified resistance value, a transistor Tr and a capacitor C and a series circuit comprising a transistor circuit TrC and a resistor $R_2$ of a lower than said specified valve resistance value, said transistor circuit TrC having a base connected to a base trigering circuit Bc1 for controlling the triggering of said transistor circuit TrC, said base circuit Bc1 having a thyristor SCR connected thereto to control the turn-off of said transistor circuit TrC, said transistor Tr having its base connected to the emitter of said transistor circuit TrC and its collector connected to the gate of said thyristor SCR, a premature firing prevention circuit Pc1 comprised of a series circuit comprising a reversed diode $D_4$ and a resistor $R_7$ being inserted between the base of said transistor circuit TrC and the negative side terminal of the primary winding $T_1$ when the forward voltage is generated.

10. An ignition system according to claim 9 wherein a forward Zener diode $ZD_2$ is used in place of the resistor $R_7$ in the premature firing prevention circuit Pc1.

11. A non-contact ignition system for an internal combustion engine comprising an ignition coil T with a plug P connected to a secondary winding $T_2$, said ignition coil T having a primary winding $T_1$ connected in parallel with a series circuit comprising a resistor $R_3$ of a specified resistance value, a transistor Tr and a capacitor C and a series circuit comprising a transistor circuit TrC and a resistor $R_2$ of a lower than said specified valve resistance value, said transistor circuit TrC having a base connected to a base trigering circuit Bc1 for controlling the triggering of said transistor circuit TrC, said base circuit Bc1 having a thyristor SCR connected thereto to control the turn-off of said transistor circuit TrC, said transistor Tr having its base connected to the emitter of said transistor circuit TrC and its collector connected to the gate of said thyristor SCR, a premature firing prevention circuit Pc1 functioning also as the discharge circuit Hc1 being inserted between the base of said transistor circuit TrC and the emitter of the transistor Tr, and a reversed Zener diode $ZD_4$ forming a part of the premature firing prevention circuit Pc1 being inserted between the collector and base of said transistor circuit TrC.

* * * * *